United States Patent [19]

Littwin

[11] Patent Number: 4,672,272

[45] Date of Patent: Jun. 9, 1987

[54] FLAT PICTURE REPRODUCTION DEVICE

[75] Inventor: Burkhard Littwin, Hohenschäftlarn, Fed. Rep. of Germany

[73] Assignee: Siemens Aktiengesellschaft, Berlin and Munich, Fed. Rep. of Germany

[21] Appl. No.: 549,579

[22] Filed: Nov. 7, 1983

[30] Foreign Application Priority Data

Nov. 10, 1982 [DE] Fed. Rep. of Germany ..... 3241605

[51] Int. Cl.[4] ..... G07G 3/10

[52] U.S. Cl. ..... 315/169.1; 315/3; 315/366; 313/422

[58] Field of Search ..... 313/422, 492, 491, 421; 315/169.1, 169.4, 366, 3

[56] References Cited

U.S. PATENT DOCUMENTS

| | | | |
|---|---|---|---|
| 3,800,186 | 3/1974 | Yamane et al. | 313/492 |
| 3,956,667 | 5/1976 | Veith | 315/169.4 |
| 3,992,644 | 11/1976 | Chodil et al. | 313/491 |
| 4,160,191 | 7/1979 | Hausfeld | 315/169.4 |
| 4,213,072 | 7/1980 | Veith et al. | 313/491 |
| 4,220,892 | 9/1980 | Van Raalte | 313/470 |
| 4,229,766 | 10/1980 | Sipos | 315/169.4 |
| 4,404,493 | 9/1983 | Nonomura et al. | 313/422 |
| 4,417,184 | 11/1983 | Takesako et al. | 313/422 |

FOREIGN PATENT DOCUMENTS

| | | |
|---|---|---|
| 2742555 | 9/1976 | Fed. Rep. of Germany . |
| 2412869 | 10/1980 | Fed. Rep. of Germany . |

*Primary Examiner*—Saxfield Chatmon

*Attorney, Agent, or Firm*—Herbert L. Lerner; Laurence A. Greenberg

[57] ABSTRACT

A flat picture reproducing device includes a vaccum-tight envelope containing an electrode matrix formed of row conductors and column conductors disposed in front of the row conductors and having holes at respective crossings thereof, the matrix dividing the interior of the envelope into a rear and a forward chamber; an areal electron source in the rear chamber; elongated vertical deflection electrodes disposed in the forward chamber in a plane parallel to the plane of the matrix and, respectively, running between rows of the holes parallel to the row conductors, a respective single one of the vertical deflection electrodes being disposed between respective hole rows of adjacent pairs of the hole rows; the envelope having a wall on the forward side thereof coated with a layer of material luminescent when excited by electrons; an addressing circuit for scanning the row conductors sequentially to construct a picture line-by-line, each of the row conductors remaining addressed for at least one picture-row period, the addressing circuit providing the respective column conductors, during each picture-row period, with appertaining picture-row information signals so that the electrons delivered by the electron source can pass selectively through the holes of the electrode matrix; the vertical deflection electrodes having different potentials applicable thereto in synchronism with the picture frequency in a manner that the electrons entering the forward chamber are deflected, respectively, upwardly or downwardly.

11 Claims, 6 Drawing Figures

FLAT PICTURE REPRODUCTION DEVICE

The invention relates to a flat picture tube having a picture screen of the type disclosed in German Published Non-Prosecuted Application (DE-OS) 27 42 555.

The heretofore known display operates in accordance with the following principle: Electrons which are generated in a rear chamber over a large area pass through selectively opened holes of an electrode matrix into a forward chamber wherein they are post-accelerated and finally strike a luminescent screen on the forward side. This concept promotes a relatively flat construction and ensures an optically trouble-free display of fast moving events at least if the electrons are obtained from a wedge-shaped gas discharge and the post-acceleration space is maintained plasma-free utilizing Paschen's law (German Patent No. 24 12 869). With increasing picture-element density, it becomes increasingly difficult, however, to construct the electrode matrix so that its filigree conductor pattern and its fine hole raster are exact over the entire display surface.

These manufacturing difficulties are mitigated if the individual electron beams are permitted to scan several picture elements, respectively, by a programmed post-deflection. In the aforecited German published non-prosecuted application, there is proposed for this purpose to place in the post-acceleration chamber or space two additional insulating plates formed with perforations or punctures, those plates, considered in viewing direction, being located in front of the row conductors and column conductors, respectively, of the electrode matrix and being provided on the walls thereof parallel to the rows and columns, respectively, with a respective deflection electrode, the electrodes of each plate being mutually connected in the form of interdigital combs. The picture tube can serve for displaying color television pictures and in that case is addressed as follows: The matrix rows are scanned sequentially and, during a row scanning time T, all of the columns simultaneously receive the appertaining data signals and in fact, sequentially, the three color separations of the complete row information. The deflection electrodes parallel to the columns are switched-over in synchronism with the color change in such a manner that the electrons are deflected to the left hand side during the period T, then fly straight and thereafter experience a deflection to the right hand side. The deflection electrodes which are parallel to the rows and deflect the electrons upwardly and downwardly, respectively, are switched over, respectively, when half a frame is built up; they therefore ensure half-frame interleaving.

In such a two-dimensional beam deflection, the number of matrix openings can be reduced drastically, and a distinctly smaller effort or lower expense for addressing and contacting is sufficient. Overall, however, the greater ease of production is only relatively modest because the deflection electrode systems must be prepared very carefully, especially since flashovers can readily occur between the closely adjacent electrode pairs.

It is therefore an object of the invention to provide a display device of the type mentioned at the introduction hereto, which can be manufactured more conveniently and wherein in principle, the same number of contacts and the same switching means as in the aforementioned prior-art device are sufficient.

With the foregoing and other objects in view, there is provided, in accordance with the invention, a flat picture-reproducing device comprising a vacuum-tight envelope containing an electrode matrix formed of row-conductors and column conductors disposed in front of the row conductors and having holes at respective crossings thereof, the matrix dividing the interior of the envelope into a rear and a forward chamber; an areal electron source in the rear chamber; elongated vertical deflection electrodes disposed in the forward chamber in a plane parallel to the plate of the matrix and, respectively, running between rows of the holes parallel to the row conductors, a respective single one of the vertical deflection electrodes being disposed between respective hole rows of adjacent pairs of the hole rows; the envelope having a wall on the forward side thereof coated with a layer of material luminescent when excited by electrons; an addressing circuit for scanning the row conductors sequentially to construct a picture line-by-line, each of the row conductors remaining addressed for at least one picture-row period, the addressing circuit providing the respective column conductors, during each picture-row period, with appertaining picture-row information signals so that the electrons delivered by the electron source can pass selectively through the holes of the electrode matrix; the vertical deflection electrodes having different potentials applicable thereto in synchronism with the picture frequency in a manner that the electrons entering the forward chamber are deflected, respectively, upwardly or downwardly.

The proposed inventive device is based on the consideration that the pairs of deflection electrodes respectively assigned to the matrix conductors need by no means be separated from one another; the objective is achieved also if adjacent deflection capacitors share an electrode, respectively. If such a coupling is permitted, the number of electrodes is reduced to one-half and because of the relatively large spacings between the electrodes, short circuits no longer need to be expected; in addition, the entire deflection part can be realized in a very simple form, for example, as a cross grid of taut wires. The number of external contacts need not be increased because the horizontally and the vertically deflecting electrodes can also be combined interdigitally. The addressing technique can, in principle, also remain the same: with the vertical deflection, one may possibly go to other switching cycles and phases, and the horizontal deflection can be controlled in a conventional manner. Care must be taken, however, that adjacent electron beams of one row are always deflected in opposite directions; optionally, the color dots on the picture screen may have to be rearranged, therefore, for example, from the usual color sequence red-green-blue into the scheme red-green-blue-blue-green-red. If one wanted to stay with the customary color distribution, the circuit would have to be desigend so that adjacent column conductors would receive, during each row scan, the row information signal thereof with interchanged color sequence; this is possible without very great difficulty.

In accordance with another feature of the invention, each of the row conductors is remainable in keyed-on condition for two picture-row periods, the potentials at the vertical deflection electrodes being switchable in synchronism with advancement of the row conductors, shifted, however, by one picture row.

In accordance with a further feature of the invention, the phosphor layer is subdivided into strips extending parallel to the row conductors, respective pairs of the strips being assigned to each of the row conductors, the electrode matrix having narrow holes extending parallel to the column conductors and being formed, as viewed in direction of extension thereof, at least as large as the phosphor strips.

In accordance with an additional feature of the invention each of the row conductors is remainable in keyed-on condition for two picture-row periods, the time of the keyed-on periods for successive row conductors overlapping one picture-row period, respectively, the potentials at the vertical deflection electrodes being switchable with equal clock frequency and in equal phase with the picture-row change.

In accordance with still another feature of the invention the layer of luminescent material is a phosphor layer and is sub-divided into strips parallel to the row conductors, respective ones of the strips running along between respective pairs of the row conductors located adjacent one another.

In accordance with again an additional feature of the invention, there are provided elongated horizontal electrodes disposed in the forward chamber in a plane parallel to the matrix plane and, respectively, running between rows of the holes of the electrode matrix in parallel with the column conductors, and switchable at least in synchronism with the picture-row change, only a single horizontal deflection electrode, respectively, being disposed between respective pairs of adjacent rows of the holes parallel to the column conductors.

In accordance with again a further feature of the invention, for displaying color pictures based upon three basic colors, the layer of luminescent material being a phosphor layer subdivided into strips parallel to the row conductors, the strips, in turn, being subdivided into sections of different basic colors, the horizontal deflection electrodes being switchable at a frequency three-times the picture-row change frequency, the holes of the electrode matrix having a greater area than that of the phosphor strip sections.

In accordance with still a further feature of the invention, the deflection electrodes are wires fixed by glass solder columns to a carrier of the electrode matrix.

In accordance with an added feature of the invention, there is provided in the forward chamber, a deflection plate disposed parallel to the electrode matrix holes, the deflection plate carrying on the rear and forward side thereof strip-shaped horizontal and vertical deflection electrodes, respectively, the horizontal deflection electrodes having projections extending forwardly through the cutouts.

In accordance with again an additional feature of the invention the vertical deflection electrodes form separate groups, within which the vertical deflection electrodes are connected together interdigitally; respective groups of the electrodes assigned to a respectively keyed-on row conductor receiving deflection potentials; and all other groups of the electrodes being connected to a cutoff voltage.

In accordance with a concomitant feature of the invention there is provided a cathode formed from mutually parallel strips in the rear chamber, the electrode groups respectively comprising those of the vertical deflection electrodes which are disposed opposite the cathode strips.

Other features which are considered as characteristic for the invention are set forth in the appended claims.

Although the invention is illustrated and described herein as embodied in a flat picture reproduction device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

For greater clarity, the figures are kept greatly diagrammatic, in part; details such as electrode leads, through contacts or mounting elements which do not contribute to an understanding of the invention, have been omitted.

Figure 1:
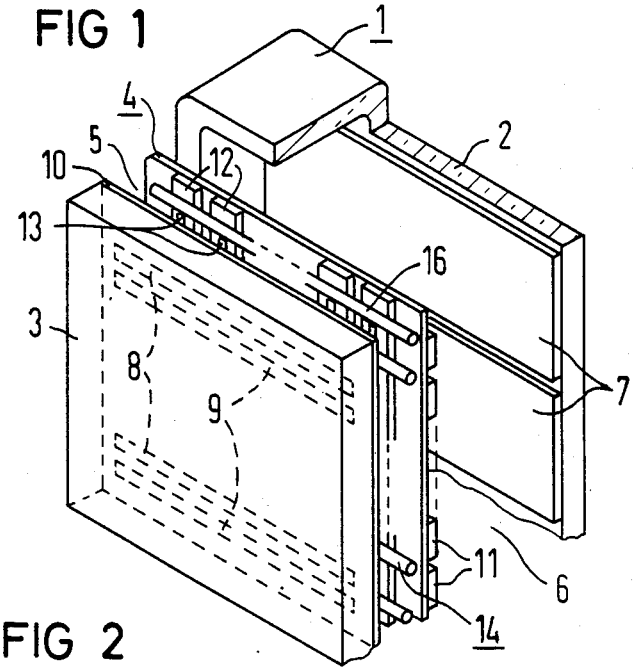
FIG. 1 is a perspective view, partly in section and partly broken away, of a first embodiment of the flat picture reproducing device.

Referring now more specifically to the drawing and first, particularly, to FIG. 1, there is shown a flat picture screen which serves for reproducing black and white television pictures. In detail, it contains a gas-filled envelope 1 with a back plate 2, a front plate 3 and a control plate 4. All three parts extend in planes parallel to one another, the control plate 4 dividing the interior of the envelope 1 into two chambers, respectively enclosing a front post-acceleration space 5 and a rear gas discharge space 6.

The rear plate 2 is provided on the front or forward side thereof with a family of mutually parallel relatively large-area cathode strips 7. The front plate 3 carries, on the rear side thereof, a regular raster of phosphor strips 8, 9 and, on top thereof, a post accelerating anode 10.

The control plate 4 is constructed as follows: a carrier of insulating material is provided on the rear and front side, respectively, with a family of strip-like, mutually parallel conductors (row conductors 11 and column conductors 12, respectively). The row conductors extend parallel to the cathode strip 7, and the column conductors extend perpendicularly thereto. The plate and the conductors are broken-through at the crossing points of the electrode matrix, so that electron passageway openings 13 are obtained. A pair of phosphor strips 8, 9 is assigned to each and are offset slightly at the top and at the bottom, respectively, relative to the openings.

A deflection unit 14 is placed in front of the control plate 4 and, in the case at hand, is formed mainly of wires 16. The wires 16 are located in a plane parallel to the control plate 4 and are arranged so that they extend, as seen from a direction perpendicular to the plane of the control plate 4, respectively between two adjacent rows of openings parallel to the row conductors 11. Even-numbered and odd-numbered wires are connected, respectively, to a common non-illustrated voltage source.

In the operation of the picture tube, the following voltages are applied to the individual electrodes: −200 V and 0 V, respectively, to the selected and non-selected cathode strips; 0 V and −50 V, respectively, to the keyed-on and non-keyed-on row conductors; between −80 V and −30 V to the column conductors; either +50 V and −50 V, respectively, or −50 V and +50 V, respectively, to the even-numbered and odd-numbered deflection electrodes; and +4 kV to the post-acceleration anode. The row conductors 11 are keyed sequentially i.e. they are raised successively to the voltage 0 V. The cathode voltages are synchronized with the line scan voltages in such a manner that a plasma burns, when lines are stepped, between the selected row conductor and the cathode strip just opposite it, respectively. The column conductors 12 during the time in which a given row conductor is addressed, sequentially receive the information signals of two picture lines; each line row conductor scanning time, therefore includes two picture row periods. The deflection lines are switched-over with the stepping frequency for the row conductors 11 and, indeed, in such a manner that the switching of the wires leads by one picture row. Accordingly, the electron beam of each row of openings is directed first towards one and then towards the other phosphor strip of the associated pair of strips, so that, after a complete line conductor scanning cycle is completed, a picture with twice the picture element density is completely constructed.

If the electron beams are then to be deflected also in the direction of the row conductors 11, then the deflection unit must be given a second grid electrode which must be oriented relative to the column conductors 12 exactly as the first grid electrode is oriented relative to the row conductors 11 and, in other respects, can be constructed exactly the same.

Figure 2:
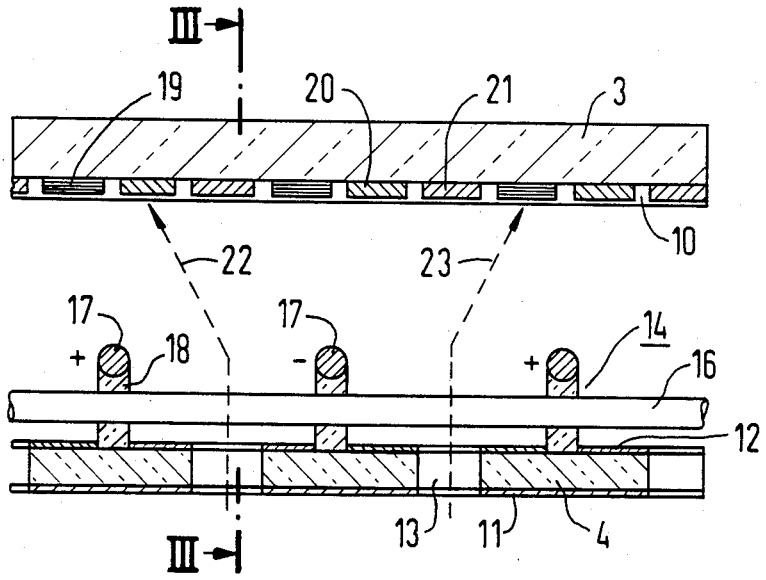
FIG. 2 is a top plan view, partly in section and partly broken away, of a forward part of a further embodiment of the invention.
Figure 3:
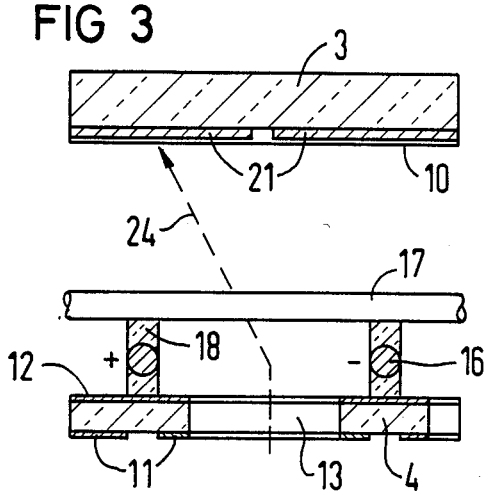
FIG. 3 is a cross-sectional view of FIG. 2 taken along the line III—III.

A concrete embodiment with respect thereto is shown in FIGS. 2 and 3: In front of the horizontal vertical-deflecting wires 16, positioned in a plane which is likewise parallel to the control plate 4, there are further vertical horizontal-deflecting wires 17 which run between respective adjacent column conductors 12.

Both electrode planes are fixed by columns of glass solder 18 in a position insulated from one another at the crossings of the wires. The glass solder columns 18 start from the control plate 4 and thus hold the entire deflection system in adjusted position. This electrode system is part of a display device which displays color pictures by means of three basic colors. The wires 17 take over the color deflection i.e. the electron beams are led during each picture row period sequentially to different color sections 19, 20 and 21 of a phosphor strip 8 or 9. As illustrations, paths 22, 23, 24, which can be taken by the electron beams in a given switching state of the deflection unit, are shown in FIGS. 2 and 3.

Figure 4:
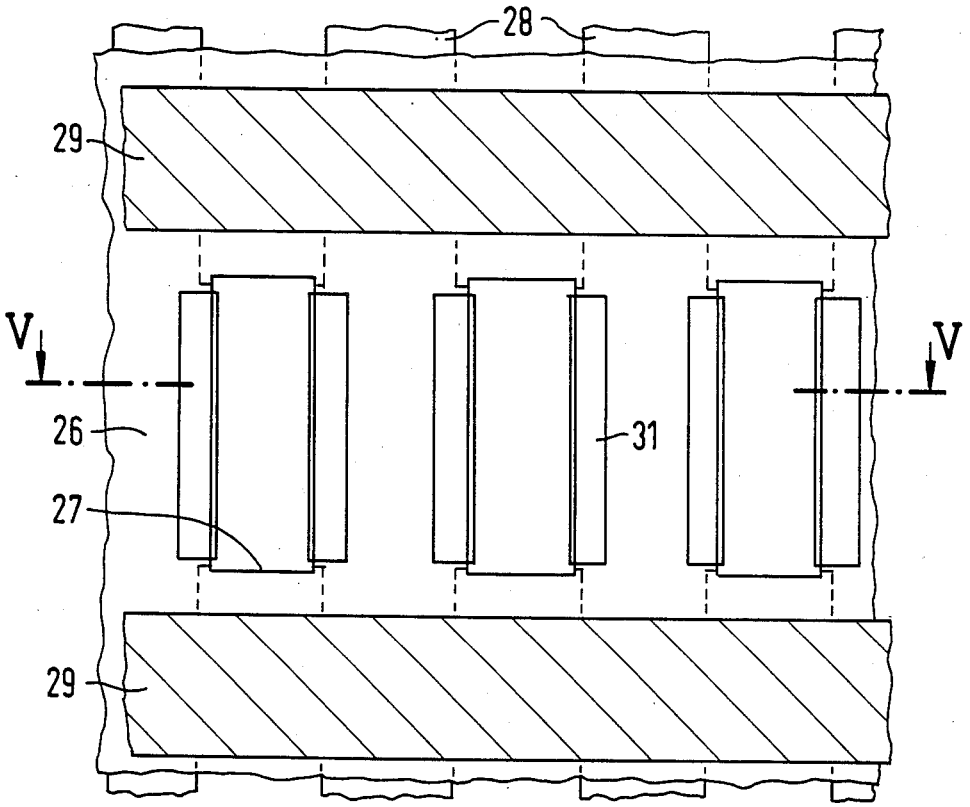
FIG. 4 is a front elevational view, partly in section and partly broken away of a deflection unit of a third embodiment of the invention.
Figure 5:
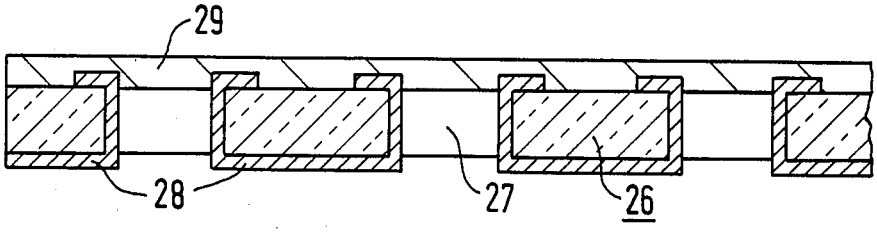
FIG. 5 is a cross-sectional view of FIG. 4 taken along the line V—V.

The deflection unit could also be realized employing thin-film technology. In FIGS. 4 and 5, a corresponding embodiment is shown, wherein a deflection plate 26 has regularly arranged cutouts 27 which are aligned with the openings 13 of the control plate 4, and carries on both sides thereof strip-shaped electrodes 28, 29. The rear electrodes 28, which ensure the color scanning, run between two respective cutout rows which are parallel to the column conductors, and the electrodes 29 on the front side (which deflect the electron beams vertically) are placed between the rows of breakthroughs or cutouts which are parallel to the row conductors. The electrodes 28 have extensions 31 by which they extend through the cutouts 27 in order to increase the deflection distance. The deflection plate 26 rests on the control plate 4 in such a manner that there are no undesired contacts.

Figure 6:
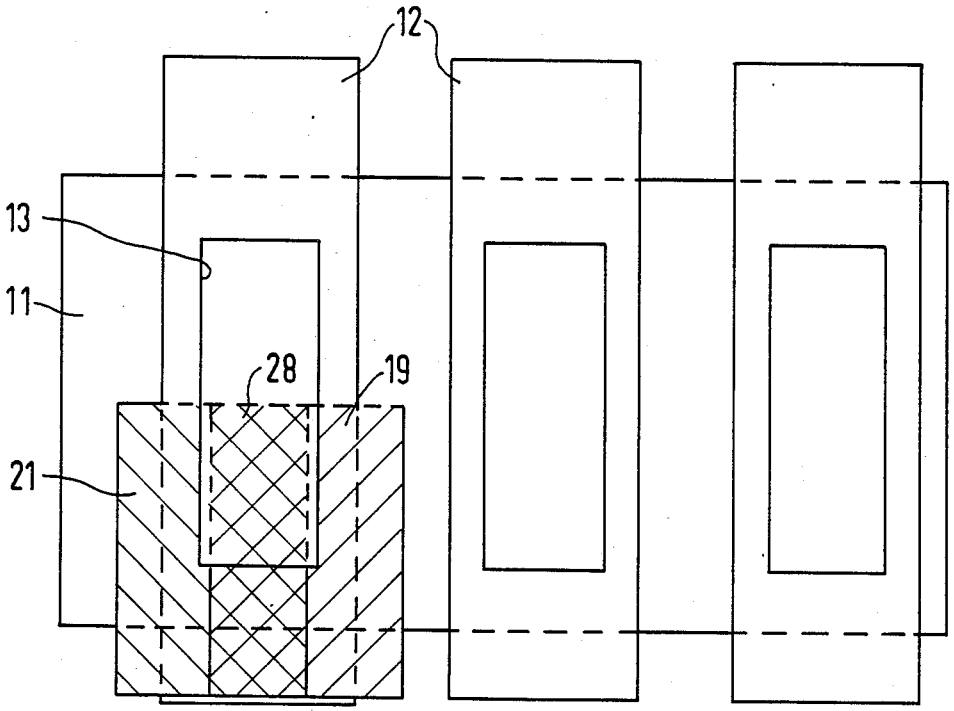
FIG. 6 is a front elevational view, partly broken away, of a control plate identical to all of the embodiments of the invention, with a color triplet of the cathodoluminescent layer arranged in front.

The control and deflection part should be of such dimensions that the electron beams excite the individual phosphor strip sections over an area which is as great as possible in order to optimize the light yield and service life of the fluorescent material. Normally, the electro-optical relations in the post-acceleration space are of such a nature that the sections 19, 20, 21 are luminescent over the entire surface thereof if the control plate openings 13 (which are usually upright rectangles) are higher and of similar width. FIG. 6, in this connection, in a view which is to-scale, illustrates a construction which presents no particular difficulties in production. The row conductors 11 and the column conductors 12 are 0.75 mm and 0.32 mm wide, respectively, and are spaced from each other 0.11 mm and 0.16 mm, respectively. The openings have an area of $0.54 \times 0.20$ mm$^2$, and the individual phosphor strip sections 19, 20 and 21 of a color triplet, which together form a square, are 0.48 mm high and 0.16 mm wide.

If the display is disturbed by column cross talk, it is advisable to separate the interdigitally connected vertical deflection electrodes into individual groups and to address them as follows: that group which includes the deflection capacitor ahead of the row conductor just being scanned receives the deflection voltage, while all other groups are at cutoff potentials. If the cathode is subdivided, the vertical deflection electrode opposite a respective cathode strip are to be combined. Further details thereof can be found in copending U.S. patent application Ser. No. 470,702 filed Feb. 28, 1983 and assigned to the same assignee as that the instant application.

As noted hereinbefore, the invention is not limited to the embodiments shown.

If one considers that, in the present context, the only important point is to realize the deflection in the vertical and, optionally, also in the horizontal direction with one respective electrode between adjacent row or column conductors, it becomes clear that several further variants are possible with respect to construction and addressing. Thus, the information could be written-in, for example, by half frames, in such a way, that the individual row conductors remain addressed (activated) only for one picture row period, and the deflection electrodes which are parallel to the rows are switched synchronously as to half frame cycle and phase. Apart from that, it is also conceivable in individual cases to select simultaneously two adjacent row conductors, to shift them, row conductor by row conductor in the rhythm of the picture row change, and to switch the vertical deflection electrodes synchronously as to clock and phase in such a manner that the electron beams of the two scanned row conductors are always deflected towards one another. Two adjacent phosphor strips are thereby similarly excited; these dual strips can therefore also be contracted to form a single strip which runs between the respective row conductors. Such an addressing technique is worth considering particularly if the picture elements are to light up over a large area and the requirements as to picture resolution are not excessive.

I claim:

1. Flat picture reproducing device comprising a vacuum-tight envelope containing an electrode matrix formed of row conductors and column conductors disposed in front of said row conductors and having holes at respective crossings thereof, said matrix dividing the interior of said envelope into a rear and a forward chamber; an area electron source in said rear chamber; horizontally oriented elongated vertical-deflection electrodes disposed in said forward chamber in a plane parallel to the plane of said matrix and, respectively, disposed between adjacent rows of said holes parallel to said row conductors, a respective single one of said vertical-deflection electrodes being disposed between respective hole rows of adjacent pairs of said hole rows; said envelope having a wall on the forward side thereof coated with a layer of luminescent material excited by said electrons; a control circuit for scanningly activating said row conductors sequentially to construct a picture line-by-line, each of said row conductors remaining activated for at least the duration of one picture row period, said control circuit providing the respective column conductors, during each picture row period, with appertaining picture-row information signals so that the electrons delivered by said electron source can pass selectively through said holes of said electrode matrix; said vertical-deflection electrodes having different potentials applicable hereto in synchronism with at least the picture frequency in a mannber that the electrons entering said forward chamber are deflected, respectively, in upward or downward direction from said holes.

2. Device according to claim 1, wherein each of said row conductors is remainable in keyed-on condition for two picture-row periods, said potentials at said vertical-deflection electrodes being switchable in synchronism with advancement of said row conductors, shifted, however, by one picture row.

3. Device according to claim 2, wherein said phosphor layer is subdivided into strips extending parallel to said row conductors, respective pairs of said strips being assigned to each of said row conductors, said electrode matrix having narrow holes extending parallel to said column conductors and being formed, as viewed in direction of extension thereof, at least as large as said phosphor strips.

4. Device according to claim 1, wherein each of said row conductors is remainable in keyed-on condition for two picture-row periods, the time of said keyed-on periods for successive row conductors overlapping one picture-row period, respectively, said potentials at said vertical deflection electrodes being switchable with equal clock frequency and in equal phase with the picture-row change.

5. Device according to claim 4 wherein said layer of luminescent material is a phosphor layer and is subdivided into strips parallel to said row conductors, respective ones of said strips running along between respective pairs of said row conductors located adjacent one another.

6. Device according to claim 1, including elongated horizontal electrodes disposed in said forward chamber in a plane parallel to said matrix plane and, respectively, running between rows of said holes of said electrode matrix in parallel with said column conductors, and switchable at least in synchronism with the picture-row change, only a single horizontal-deflection electrode, respectively, being disposed between respective pairs of adjacent rows of said holes parallel to said column conductors.

7. Device according to claim 6, for displaying color pictures based upon three basic colors, said layer of luminescent material being a phosphor layer subdivided into strips parallel to the row conductors, said strips in turn, being subdivided ito sections of different basic colors, said horizontal-deflection electrodes being switchable at a frequency three-times the picture-row change frequency, said holes of said electrode matrix having a greater area than that of said phosphor strip sections.

8. Device according to claim 1 wherein said deflection electrodes are wires fixed by glass solder columns to a carrier of said electrode matrix.

9. Device according to claim 1 including, in said forward chamber, a deflection plate disposed parallel to said electrode matrix and formed with cutouts aligned with said matrix holes, said deflection plate carrying on the rear and forward side thereof strip-shaped horizontal and vertical-deflection electrodes, respectively, said horizontal deflection electrodes having projections extending forwardly through said cutouts with extensions.

10. Device according to claim 1 wherein said vertical-deflection electrodes form separate groups, within which said vertical-deflection electrodes are connected together interdigitally; respective groups of said electrodes assigned to a respectively keyed-on row conductor receiving deflection potentials; and all other groups of said electrodes being connected to a cutoff voltage.

11. Device according to claim 10, including a cathode formed from mutually parallel strips in said rear chamber, said electrode groups respectively comprising those of said vertical deflection electrodes which are disposed opposite said cathode strips.

* * * * *